United States Patent [19]

Patel et al.

[11] 4,376,135

[45] Mar. 8, 1983

[54] APPARATUS FOR ATOMIZATION IN ELECTROSTATIC COATING AND METHOD

[75] Inventors: Mulji Patel, Des Plaines, Ill.; Samuel W. Culbertson, Arvada, Colo.

[73] Assignee: Binks Manufacturing Company, Franklin Park, Ill.

[21] Appl. No.: 321,456

[22] Filed: Nov. 16, 1981

Related U.S. Application Data

[63] Continuation-in-part of Ser. No. 245,899, Mar. 20, 1981, abandoned.

[51] Int. Cl.[3] ..... B05B 15/04

[52] U.S. Cl. ..... 427/31; 118/626; 118/627; 427/240

[58] Field of Search ..... 118/626, 627; 427/31, 427/240

[56] References Cited

U.S. PATENT DOCUMENTS 3,411,715 11/1968 Wallis ..... 118/626

3,442,688 5/1969 Pettigrew ..... 118/626 X

*Primary Examiner*—Michael R. Lusignan

*Attorney, Agent, or Firm*—Gary, Juettner & Pyle

[57] ABSTRACT

Rotary devices for atomizing liquid coating material are characterized by a housing having a circular front wall, a generally cylindrical side wall and a plurality of circumferentially spaced passages formed therethrough in proximity with the juncture of the front and side walls. Coating material smoothly introduced into the housing onto the front or side wall is carried in a thin film by centrifugal force toward and into the passages for being projected therefrom and atomized, and an electrostatic field is established between the device and an article to be coated for electrostatic deposition of coating material on the article. The device is rotated at a relatively high speed, and the passages bring the coating material to the full rotational speed of the device as it is projected therefrom, whereby atomization and the quality of the coating on the article are improved.

12 Claims, 14 Drawing Figures

Fig. 4.
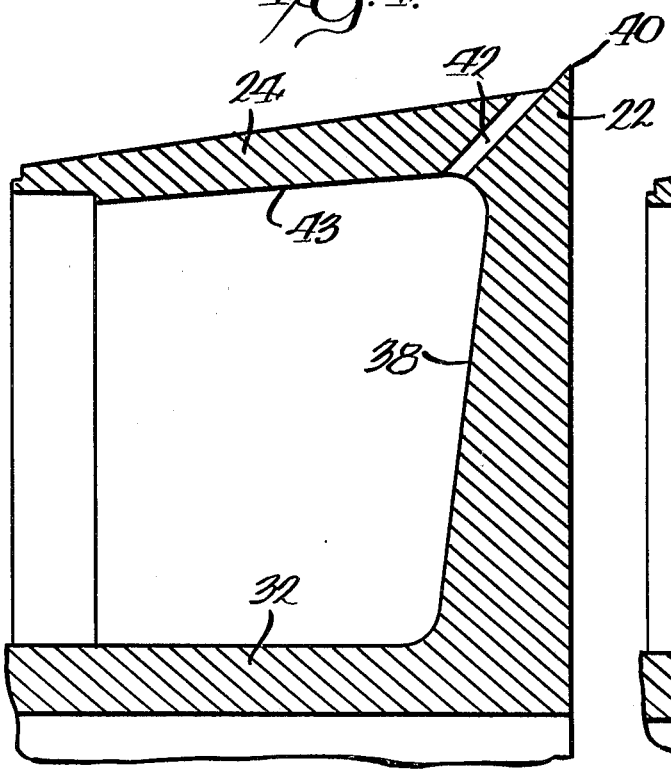
Fig. 5.
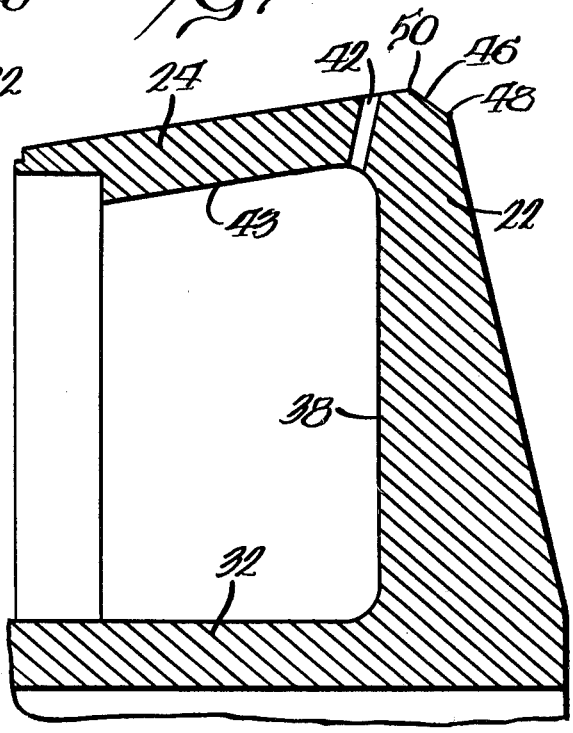
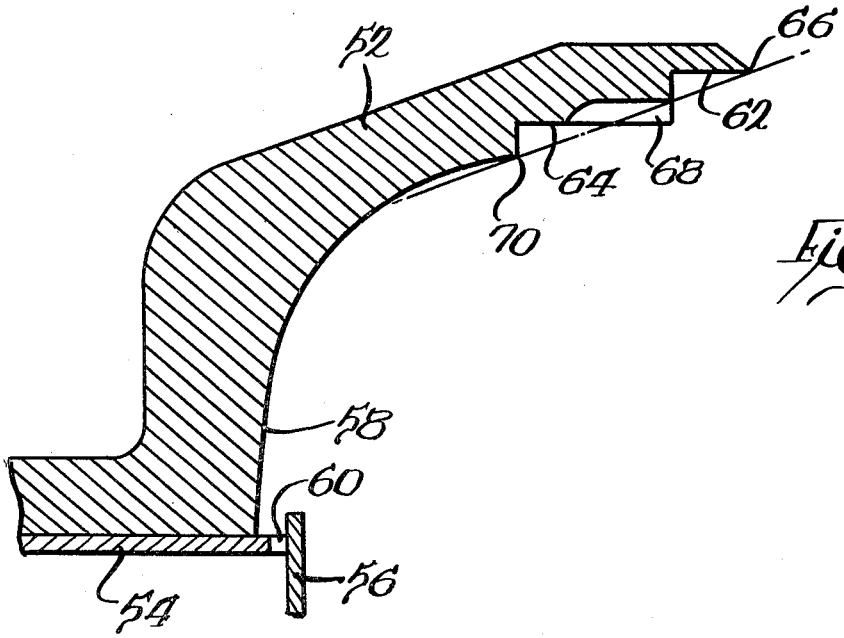
Fig. 6.

28'
24'
42'
40'
43'
38'
22'
26'
37'
34'
36'
32'
30'
42'

42'
40'
24'
22'
43'
38'

44'
40'
24'
43'
42'
38'
22'
32'

APPARATUS FOR ATOMIZATION IN ELECTROSTATIC COATING AND METHOD

This application is a continuation in part of application Ser. No. 245,899, filed Mar. 20, 1981, now abandoned.

BACKGROUND OF THE INVENTION

The present invention relates to apparatus for and methods of atomizing liquid coating material for being electrostatically deposited on an article, and in particular to apparatus and methods wherein the coating material is projected from passages formed through a rapidly rotating device for being atomized.

There has been an increasing trend in recent years toward use of liquid paints having a small solvent content and relatively high viscosity for the purpose of preventing environmental pollution. However, to satisfactorily atomize such paints using a rotary atomizing device, it is often necessary to rotate the device at high rotational speeds.

Conventional rotary atomizing devices are usually in the form of a bell or disc, and paint introduced onto a paint feed surface of the device flows in a thin film under centrifugal force to a circular peripheral discharge edge of the device and is atomized as it is projected from the edge. In use of such a device, the degree of atomization of paint is generally in inverse proportion to the thickness of the paint film at the discharge edge, which may be appreciated if it is considered that conventional rotary atomizing devices have smooth paint feed surfaces, so that with increasing thicknesses of the paint film, and considering inertia of the film and air drag on the surface of the film opposite from the paint feed surface, the less likely is the film to be brought up to the speed of rotation of the device by the time it is projected from the edge. On the other hand, film thickness is proportional to the quantity of paint discharged. Consequently, when a conventional rotary atomizing device is used to atomize a relatively large volume flow of paint, atomization suffers and the resulting coating on an article to be painted is often less than satisfactory.

When use is made of a compact rotary atomizing device in which the radius of the device is reduced to reduce its size and weight, it is necessary to significantly increase the rate of rotation of the device to obtain satisfactory atomization of paint or, on the other hand, to significantly reduce the thickness of the paint film supplied to the discharge edge of the device. However, when the rotational frequency of the device is significantly increased, considerable slippage occurs between the paint feed surface of the device and the film of paint, the velocity of the film is considerably less than that of the device as it is projected therefrom, atomization suffers and a large number of bubbles may form on the surface of the coating applied to an article. The bubbles deteriorate the quality of the coating and, if excessive, can spoil the coated article.

One prior effort to overcome the aforementioned difficulties is disclosed in U.S. Pat. No. 4,148,932, issued Apr. 10, 1979. As taught in that patent, atomization may be improved by providing the paint feed surface toward and at the peripheral discharge edge of the rotary device with circumferentially spaced, recessed grooves which extend into the edge in the direction of paint flow. Paint flows over and through the grooves in approaching the discharge edge, and while the patent attributes improved atomization to the formation of a large number of discrete cusps of paint along the whole periphery of the discharge edge, it is believed by the present inventor that improvements in atomization occur primarily because the grooves take a "purchase" on the paint film and bring its velocity toward that of the device by the time it is projected from the edge. However, because the grooves are open channels, paint is still free to slip across and between the grooves as the device rotates, so that the speed of rotation of the paint film at the discharge edge cannot reach that of the device and maximum improvements in atomization are not obtained.

OBJECT OF THE INVENTION

The primary object of the present invention is to provide apparatus for and methods of electrostatic coating using rotary atomizing devices in which liquid coating material is introduced smoothly into the device and brought fully up to the speed of rotation thereof as it is projected therefrom for being atomized, whereby atomization of the material and the quality of the coating deposited on an article are improved.

SUMMARY OF THE INVENTION

In accordance with the present invention, an apparatus for atomizing liquid coating material for electrostatic deposition on an article comprises an annular housing rotatable about its axis. The housing has a plurality of circumferentially spaced passages extending therethrough in a direction outwardly of its axis and an opening accommodating smooth introduction of coating material onto an inner surface thereof. Upon rotation of the housing and introduction of coating material onto the inner surface the material flows under centrifugal force into and through the passages and is atomized as it is projected from and beyond the passages, with the passages constraining the material to the same rotational velocity thereas for improved atomization of the material.

In another embodiment, the apparatus comprises a cup-shaped housing having a circular frontal opening and a peripheral edge around the opening. The housing is rotatable about the axis of the opening and accommodates introduction of coating material onto an inner surface thereof inwardly of the opening, whereby upon rotation of the housing coating material flows in a film under centrifugal force across the inner surface to the peripheral edge and is atomized as it is projected from the edge. The apparatus is characterized in that first and second steps are formed in and circumferentially around the inner housing surface, the first step has a smooth surface and extends from the peripheral edge to a point inwardly thereof, and the second step extends from the first step to a point inwardly thereof and has a plurality of circumferentially spaced grooves formed in its surface generally along the direction of material flow. Consequently, material introduced onto the inner surface of the housing flows across the surface to the second step, is projected onto the second step and flows through the grooves to the first step, is projected onto the first step and flows to the peripheral edge and is atomized as it is projected from the edge, with the grooves increasing the rotational velocity of the material toward that of the grooves for improved atomization of the material.

The invention also provides a method of atomizing coating material using a rotary atomizing device for electrostatically coating an article with a film of material, wherein an electrostatic field is established between a peripheral edge of the rotating device and the article to be coated and the liquid material flows toward the edge of the device as a continuous film. The method is characterized by the steps of increasing the rotational velocity of the material as it approaches the peripheral edge by flowing the material into and through a series of circumferentially spaced passages which extend toward the peripheral edge, constrain the material to the same rate of rotation thereas and terminate in proximity with the edge, and atomizing the material as it is projected out of and beyond the passages.

In accordance with another embodiment, the method is characterized by the steps of flowing the film of material across circumferentially spaced grooves in a surface of a first step formed circumferentially around a material feed surface of the rotary device toward but spaced from the peripheral edge and then across a smooth surface of a second step formed circumferentially around the material feed surface and extending between the peripheral edge and the first step, wherein the grooves extend in the peripheral direction of the device and increase the rotational velocity of the material as it flows therethrough, and atomizing the material as it is projected beyond the peripheral edge.

The foregoing and other objects, advantages and features of the invention will become apparent upon a consideration of the following detailed description, when taken in conjunction with the accompanying drawings.

BRIEF DESCRIPTION OF THE DRAWINGS

FIGS. 3–5 are cross sectional, fragmentary views of alternate embodiments of devices of a type as illustrated in FIG. 1;

FIG. 6 is a cross sectional, fragmentary view of yet another type of rotary atomizing device embodying the teachings of the invention;

DETAILED DESCRIPTION

The present invention provides improved apparatus for and methods of atomizing liquid paint for being electrostatically deposited on an article. The apparatus generally comprises a rotary atomizing device in the form of a cylindrical or annular housing having front and side walls and a plurality of circumferentially spaced passages formed therethrough at or in proximity with a peripheral edge thereof at the juncture of the front and side walls. Paint introduced into an inner surface of the housing flows in a thin film under centrifugal force toward, into and through the passages, and is atomized as it is projected from the passages. A high voltage gradient is established between the rotary device and the article to be coated, whereby an electrostatic field exists between the device and the article and the atomized paint is electrostatically charged and deposited on the article. The atomizing device is rotated at a very high rate, and by virtue of the passages the paint is brought completely up to the speed of rotation of the device as it is projected from the passages and atomized, whereby improvements in atomization and the quality of the coating deposited on the article are obtained.

Figure 1:
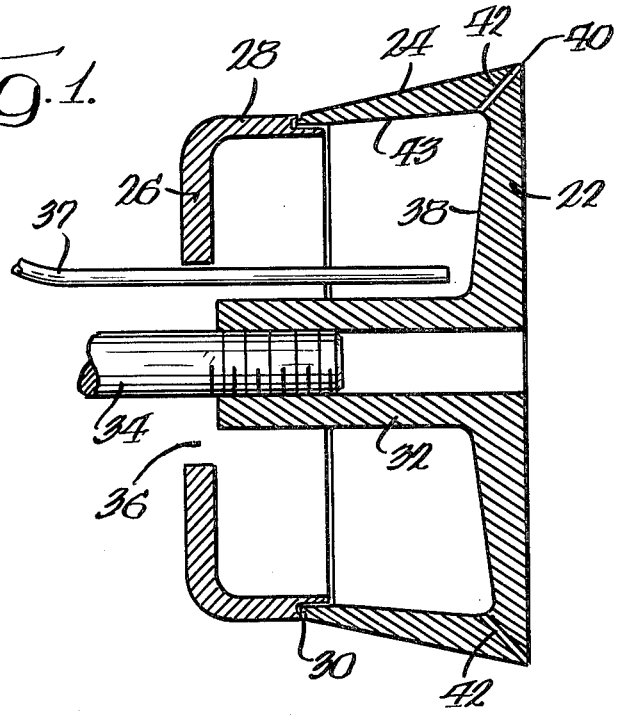
FIG. 1 is a cross sectional, side elevation view illustrating an embodiment of rotary atomizing device which incorporates the teachings of the present invention.

Referring to FIG. 1, there is shown in cross section one embodiment of rotary atomizing device structured in accordance with the teachings of the invention. The device includes a forward portion comprising a front wall 22 and a generally cylindrical side wall 24, and a rearward portion comprising a back wall 26 and a generally cylindrical side wall 28. The front and rear portions are fabricated separately for convenience in manufacture, and are then assembled and joined along a juncture 30 to complete the major body portion of the device. A boss 32 is formed with the front wall 22 and receives the forward end of a rotary shaft 34 of a rotary driving device (not shown), such as a pneumatic motor capable of high speed rotation at from about 4,000 to 60,000 rpm.

The inner edge of the back wall 26 extends toward but terminates short of the boss 32 and the shaft 34 and defines a circular opening 36 which provides access to the interior of the device. In use of the device, liquid paint from a supply thereof (not shown) is provided through a line 37 to the interior of the device. The line extends through the opening 36 and terminates toward the front wall 22, whereby paint is projected onto an inner surface 38 of the front wall. Due to rotation of the device, the paint flows in a thin film under centrifugal force radially outward toward the side wall 24.

Figure 2:
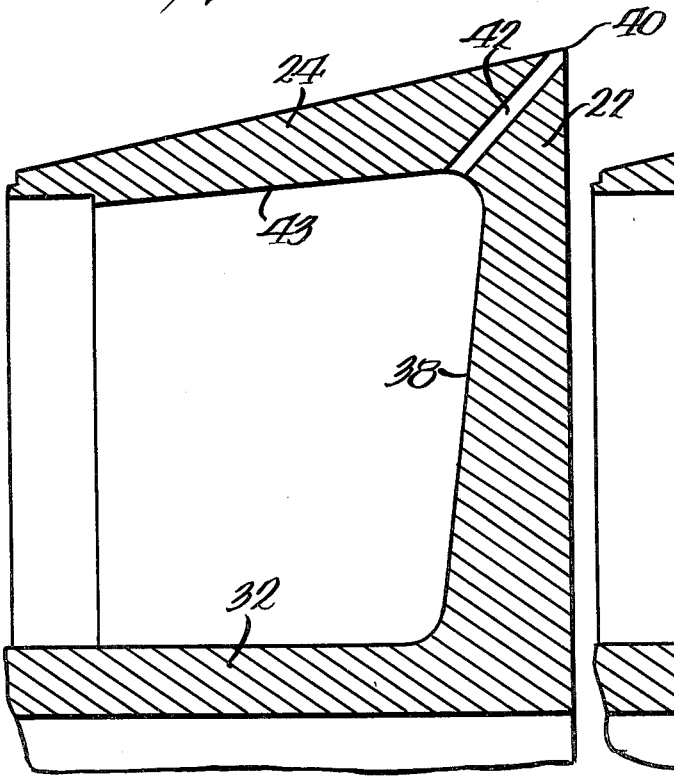
FIG. 2 is a cross sectional, exploded, fragmentary view of a portion of the device shown in FIG. 1.

In the embodiment of device under consideration, the front wall 22 and side wall 24 define a sharp, circular, peripheral edge 40 at the juncture of their outer surfaces and, as also shown in FIG. 2, a plurality of circumferentially spaced passages 42 extend through the forward portion of the device between the peripheral edge 40 and a point whereat curved surfaces of the surface 38 and an inner surface 43 of the side wall 24 join. The passages are preferably spaced at increments of about 4° around the peripheral edge, and as the paint film flows radially outwardly under centrifugal force it enters the passages, flows therethrough and is projected therefrom at the peripheral edge.

As is known, in use of rotary atomizing devices in electrostatic deposition, the device is ordinarily connected to a source of high d.c. voltage and the article grounded, whereby an electrostatic field is established between the device and article for electrostatically charging and depositing atomized paint particles on the article. Also, it is advantageous that the device be provided with a sharp edge at or in close proximity with the point from which paint is emitted, thereby to establish a high electrostatic field intensity for charging spray particles, and the sharp peripheral edge 40 serves the purpose.

In use of a rotary atomizing device having the described construction, it has been found that significant improvements are obtained in atomization. It is believed that such improvements are obtained because the paint, in flowing through the passages 42, is brought to and absolutely constrained at the same rotational velocity as the device, whereby it is projected from the device at a greater velocity than would otherwise be possible in use of a conventional device rotated at the same rate. At the same time, improvements are also obtained in the consistency of the atomized paint particles. Because paint is constrained within the passages, it is not subjected to churning or turbulence or exposed to a significant flow of air across its surface as it approaches the discharge point, as would otherwise be the case, with the result that the amount of air entrailed within atomized paint particles is significantly reduced. In consequence, virtually no foaming occurs in the coating deposited on an article, and the quality of the coating is enhanced.

Figure 3:
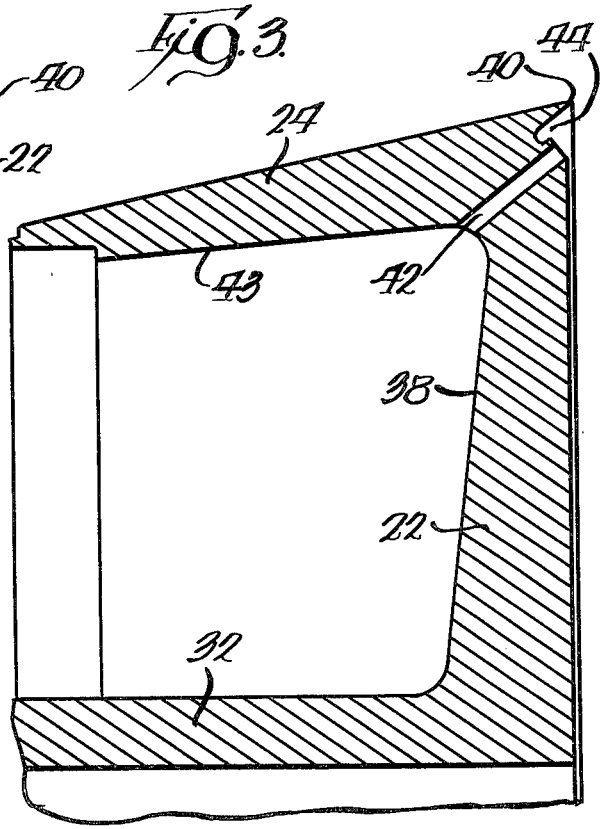
Figure 7:
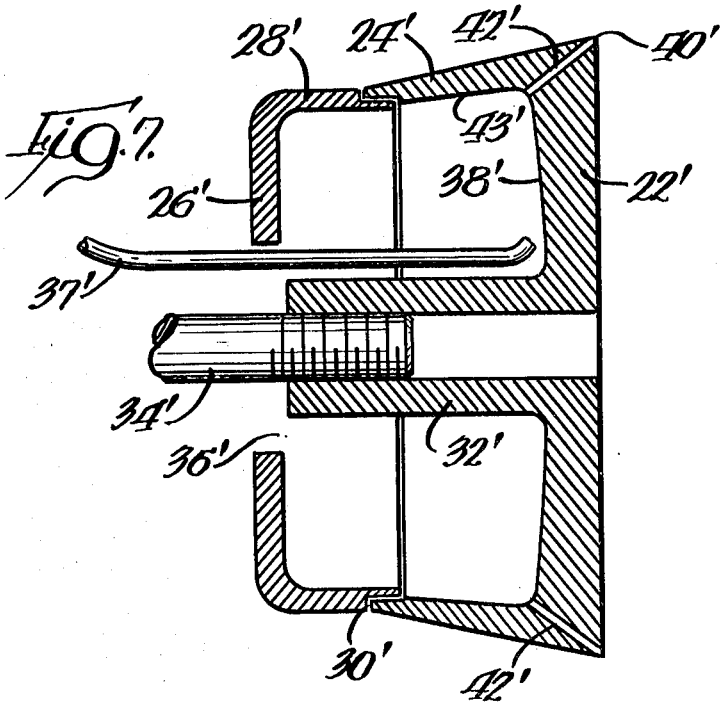
FIG. 7 is a cross sectional, side elevation view of a further embodiment of rotary atomizing device in accordance with the teachings of the invention.
Figure 8:
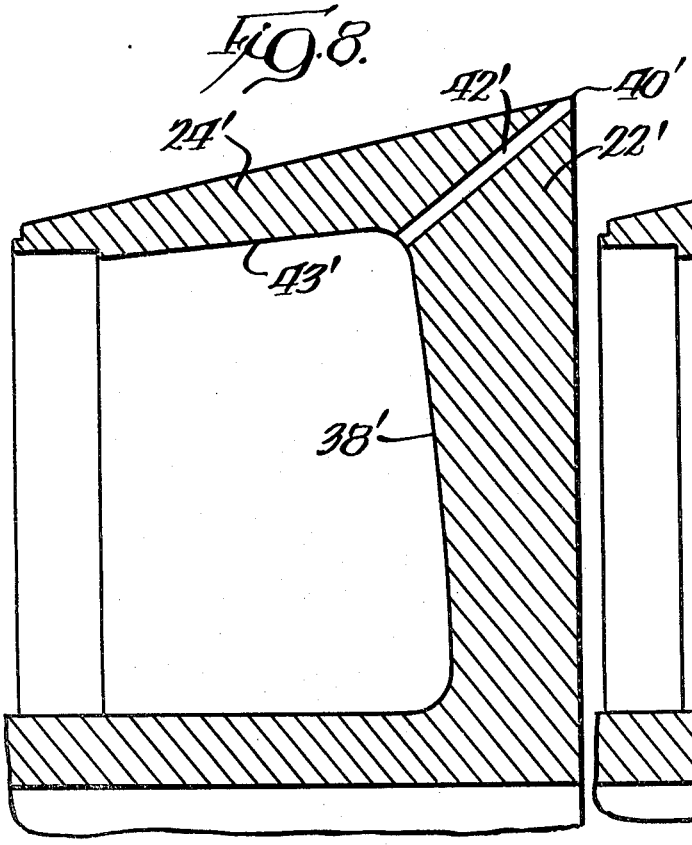
FIG. 8 is a cross sectional, fragmentary view of a portion of the device shown in FIG. 7.
Figure 9:
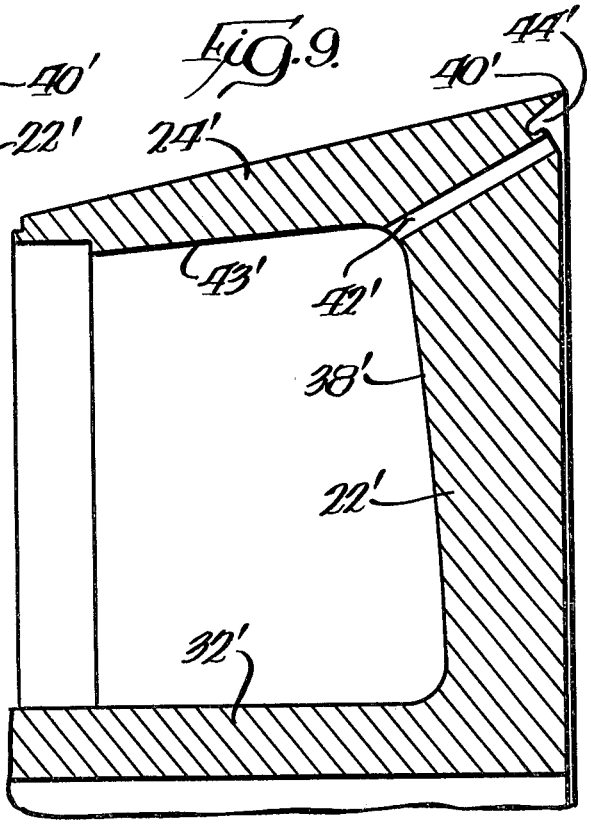
FIGS. 9–11 are cross sectional, fragmentary views of alternate constructions for devices of a type as illustrated in FIG. 7.
Figure 10:
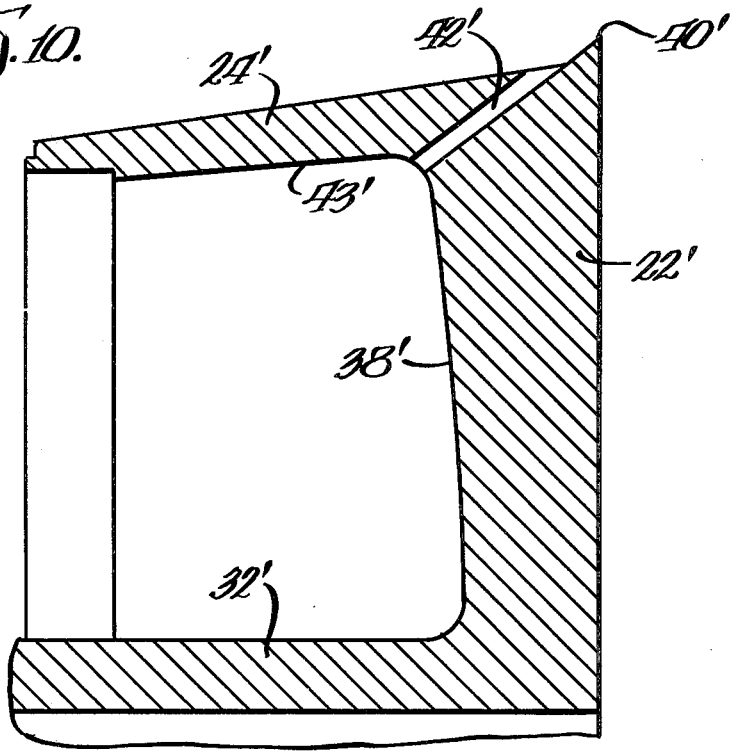
Figure 11:
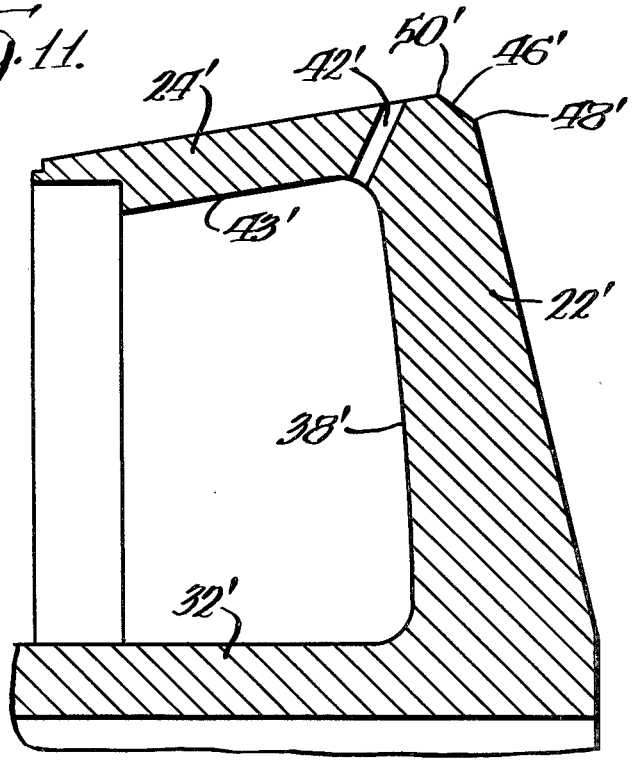

FIG. 3 illustrates another embodiment of rotary atomizing device according to the present invention. In this case, the front wall 22 has an annular recess 44 immediately inwardly of the peripheral edge 40 and the passages 42 open into the recess. Paint flowing through the passages is brought to and constrained at the rotational velocity of the device, and upon exiting is projected radially outwardly and against and/or closely past the highly charged peripheral edge, so that significant improvements in the quality of the coating on an article are obtained.

In the embodiment of device shown in FIG. 4, the peripheral edge 40 is on the front wall 22 radially outwardly of the outer surface of the side wall 24 and the passages 42 are axially inwardly of the edge. Again, in use of the device improvements in atomization and the quality of coatings deposited on articles are obtained. However, as compared with the previously described embodiments, the extent of electrostatic charging of paint particles is somewhat reduced since the particles are slightly more spaced from the edge.

In the rotary device illustrated in FIG. 5 the passages 42 open onto the outer surface of the wall 24. However, unlike the previously described embodiments there is no relatively sharp edge comparable to the edge 40, but instead the front wall 22 joins the side wall 24 by means of a short wall segment 46, which defines at its opposite ends two edges 48 and 50. The edges 48 and 50 are not as sharp as the edge 40 and are somewhat spaced from the passage outlets, and as a result decreases in electrostatic charging of paint particles are experienced. Nevertheless, as compared with the results that would otherwise be obtained with conventional devices rotated at the same speed, the quality of coatings deposited on articles are improved.

The embodiment of rotary atomizing device shown in FIG. 6 comprises a generally cup or bell-shaped housing 52 having an open forward end. The housing is mounted for rotation on a cylinder 54 having a circular disc 56 at its forward end, and the disc is provided with a centrally located boss (not shown) accommodating connection with an output shaft of a rotary driving device (also not shown). To deposit paint onto a paint feed surface 58 of the housing, a plurality of circumferentially spaced passages 60 are formed through the cylinder adjacent the disc, whereby paint projected against the disc moves outwardly under centrifugal force through the passages and onto the paint feed surface.

Unlike prior cup-shaped rotary atomizing devices, the device 52 is characterized by the formation in the paint feed surface 58 of two steps 62 and 64 toward and at a peripheral discharge edge 66. A plurality of circumferentially spaced serrations or grooves 68, which extend in the direction of paint flow, are formed in the forward surface portions of the step 64 and the surface of the step 62 is smooth. In use, paint on the surface 58 moves in a thin film radially and axially outwardly under centrifugal force and, upon leaving an inner edge 70 of the step 64, impinges on the surface of the step generally medially thereof and within the grooves. The paint then flows through the grooves and, upon leaving the grooves at the forward end of the step 64, impinges on the surface of the step 62 toward the outer end thereof, from whence it flows to the discharge edge 66 for being projected from the housing and atomized.

Several advantages are obtained with the rotary atomization device of FIG. 6. In a first instance, the grooves 68 take a "purchase" on the paint film and increase its rotational velocity beyond that which would otherwise be possible if the step 64 were smooth. Consequently, as paint leaves the grooves its velocity is sufficiently great so that, as it is projected from the discharge edge 66, improved atomization results. Also, because paint is discharged from the edge 66, significant electrostatic charges are imparted to the spray particles with a resulting enhancement in the quality of coating and wrap around effect of paint particles on the article. In addition, since the paint film does not contact the inner portions of the steps 62 and 64 cleaning of the device, for example by providing a flushing solvent therein instead of paint, is facilitated.

Although significant improvements in the quality of coatings applied on ware are obtained with the rotary atomizing devices of the type illustrated in FIGS. 1–5, it has been found that air bubbles are often present in and decrease the quality of the coatings. In that connection, disadvantages believed to reside in each device are that paint is not smoothly introduced onto the paint feed surface thereof, but instead is projected against the surface, and the inner surface of the front wall extends from the axis of rotation of the device in directions both radially and axially outwardly of the device. Because paint is projected against the inner surface of the front wall, it is believed that spattering of paint may occur with resulting entrainment of air in the paint. Also, because the surface extends axially outwardly, it is possible that not all paint introduced thereon flows smoothly to the outlet passages 42, but instead some may be flung by centrifugal force from the surface and onto the inner surface 43 of the side wall 24 before proceeding to the passages, again resulting in entrainment of air in paint.

To enhance the quality of coatings by minimizing air bubbles therein, it is contemplated that paint be smoothly flowed onto and across the inner paint feed surface of the front wall. To this end, the invention contemplates curving the paint inlet tube at its discharge end to smoothly direct paint onto the inner surface of the front wall, and constructing the front wall so that its inner surface extends from the axis of the head radially outwardly and slightly axially inwardly. An axially inward direction of the front wall will prevent paint from being flung therefrom by centrifugal force and, along with a smooth introduction of paint onto the surface, minimize the amount of air entrained in paint.

FIGS. 7–11 illustrate rotary atomizing devices constructed in a manner to decrease entrainment of air in paint while the paint is within the devices. The devices are similar to and correspond respectively with those in FIGS. 1–5, and therefore like reference numerals have been used to denote like components, except that the reference numerals in FIGS. 7–11 have been primed. The only difference between the devices is that, in each of those shown in FIGS. 7–11, the paint inlet tube 37' is smoothly curved at its discharge end in directions both radially and axially outwardly of the device, thereby to more smoothly introduce paint onto the paint feed surface 38' of the front wall 22', and the surface 38' extends from the axis of rotation of the device radially outwardly and slightly axially inwardly. Thus, paint introduced onto the surface flows outwardly therealong in a thin film under centrifugal force to the discharge passages 42', and cannot be flung against the surface 43'. In consequence, there is a reduction in air entrained in paint within the device, and therefore a reduction in the number of air bubbles in coatings on articles. It is understood, of course, that operation of the rotary atomizing devices shown in FIGS. 7–11 is substantially the same as was described in respect of the devices in FIGS. 1–5, and therefore a specific description of these latter embodiments is not deemed necessary.

Figure 12:
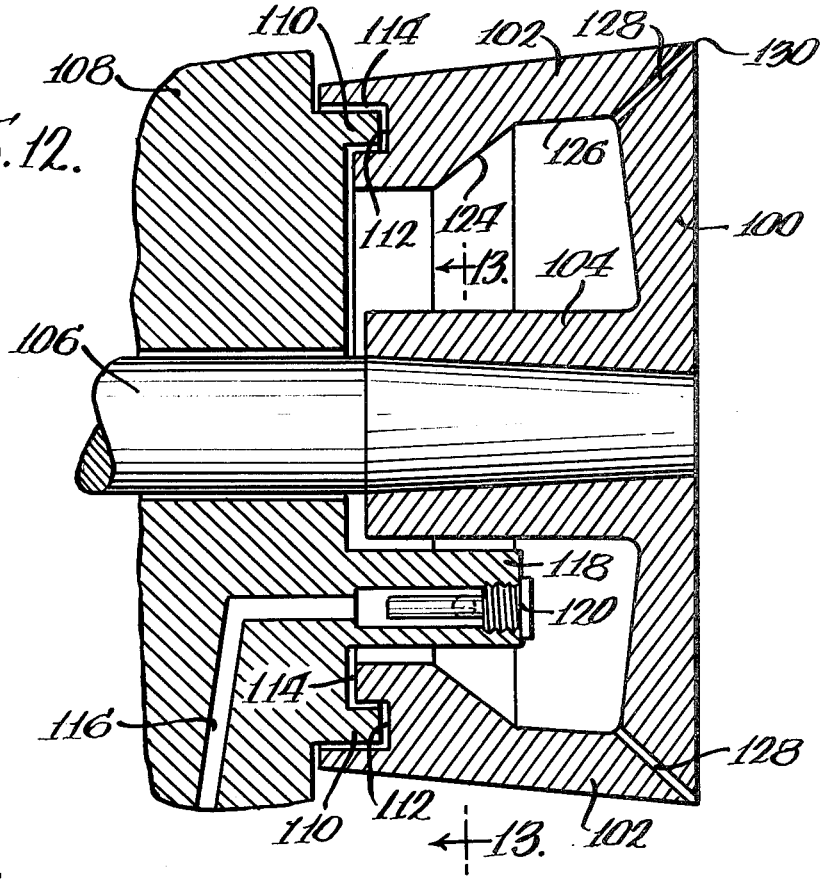
FIG. 12 is a cross sectional, side elevation view of another embodiment of rotary atomizing device in accordance with the invention, which is constructed to ensure very smooth application of coating material onto an inner paint feed surface of the device.
Figure 13:
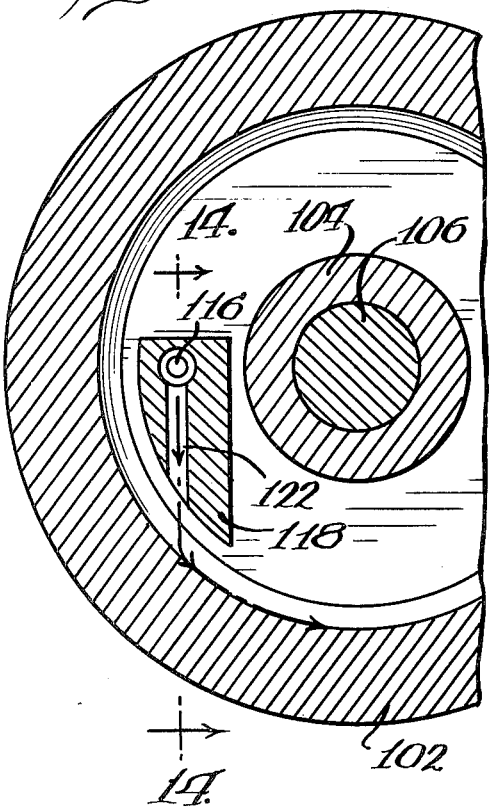
FIG. 13 is a view taken along the lines 13—13 of FIG. 12, and shows the arrangement of the coating material inlet opening to the device.
Figure 14:
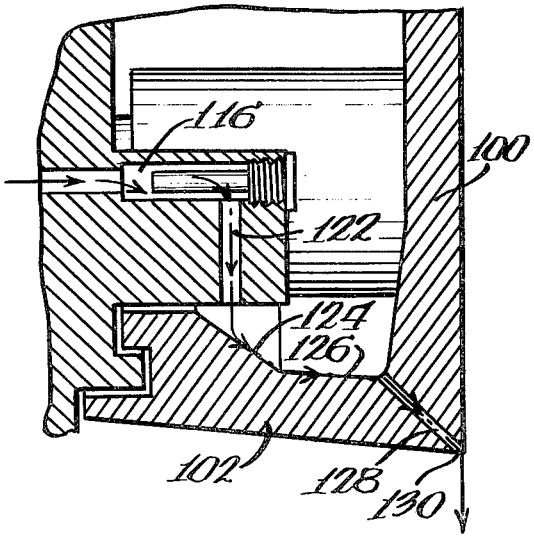
FIG. 14 is taken substantially along the lines 14—14 of FIG. 13, and illustrates the inner surface configuration of the device which accommodates a very smooth introduction of coating material onto the surface.

A preferred embodiment of rotary atomizing device contemplated by the invention is shown in FIGS. 12–14, and is constructed to both constrain paint to the rotational speed of the device as it is projected therefrom, whereby improvements in atomization are obtained, as well as to fully minimize entrainment of air in paint, so that maximum benefits are obtained and the quality of coatings applied on articles is significantly improved. The device includes a generally annular or cylindrical housing having a circular front wall 100, a generally annular or cylindrical side wall 102 and a boss 104 extending rearwardly from the front wall axially thereof. The boss receives the forward end of a rotary shaft 106 of a rotary driving device (not shown), such as a pneumatic motor capable of high speed rotation at from about 4,000 to 60,000 rpm. The shaft passes through a nonrotatable head 108 rearwardly of the atomizing device, and a forward end of the head has an annular ridge or protuberance 110 which is closely received within an annular channel 112 in and around the rearward end of the side wall 102. The rotary atomizing device is rotatable with the protuberance received within the channel, and the surfaces of the protuberance and channel are in very closely spaced relationship to impede any substantial flow of air to interior of the device through a space 114 between the surfaces.

With reference also to FIGS. 13 and 14, to introduce paint into the device a paint inlet passage 116 extends through both the head 108 and an extension 118 on the forward end of the head. The extension is received within an annular opening in the rearward end of the device between the wall 102 and the boss 104, and is positioned somewhat vertically below and horizontally to the side of the axis of rotation of the device. The forward end of the inlet passage is closed by a screw 120, which may be removed to facilitate cleaning of the passage, and a paint outlet port 122 is formed through the extension between the inlet passage and the interior of the device. Thus, paint supplied to the inlet passage flows through the passage and the outlet port, in the directions shown by arrows, to the interior of the device for deposit on an inner surface of the side wall 102.

The side wall has two inner paint feed surface portions 124 and 126, each of which defines an acute angle with respect to the axis of rotation of the device. Thus, the surfces extend both radially and axially outwardly of the device, so that paint introduced onto the surface 124 flows in a thin film under centrifugal force across the surfaces 124 and 126 to and through a plurality of passages 128 formed through the housing at the juncture of the front and side walls 100 and 102. The passages are preferably formed at about 4° increments around the front wall, and paint therein is brought to and absolutely constrained at the speed of rotation of the device, whereby upon being projected from the passages improved atomization occurs. To enhance electrostatic deposition of paint particles on an article, a sharp peripheral discharge edge 130 is defined at the juncture of the front and side walls, and causes a high intensity electrostatic field to be generated thereat for charging spray particles.

As is apparent, the passages 128 bring the paint to the rotational velocity of the device as it is projected therefrom, whereby the same improvements in atomization occur as are obtained with the devices in FIGS. 1–5 and 7–11. However, because of the particular construction of the device of FIGS. 12–14, further advantages are also obtained in minimizing entrainment of air in the paint, and therefore the number of air bubbles in coatings applied on articles. In a first instance, the paint outlet port 122 has a relatively large cross sectional flow area, so that for a given volume flow of paint to interior of the device the speed of the flow is reduced, whereby the paint may be introduced onto the surface 124 without spattering. Secondly, the surface 124 defines a relatively large acute angle with respect to the axis of rotation of the device, and therefore a relatively small acute angle with respect to the direction of paint flowed thereon, so that paint need not experience a drastic change in direction of flow as it is formed into a film, and turbulence of the paint is decreased. Also contributing to a very smooth introduction of paint onto the surface is the particular positioning of the extension 118, which as shown in FIG. 3 is slightly vertically below and horizontally to the side of the axis of rotation of the atomizing device, which further reduces the angle of incidence between the paint flow and the portion of the surface onto which it is introduced. In addition, the direction of paint flow at the point of introduction is generally in the direction of rotation of the surface 124, as shown by the arrows.

To the extent described, decreases in entrainment of air in paint have been attributed solely to accomplishing a smooth introduction of paint into the device. However, another factor contributing to entrainment of air is movement of air through the interior of the device. Just as paint moves through and out of the device under centrifugal force, so does air, and air which enters the rearward end of the device moves across the film of paint and through the passages 128 along with the paint. In rotary atomizing devices of the types shown in FIGS. 1–5 and 7–11, air may freely enter the rearward ends of the devices through the circular opening 36 accommodating entry of the paint feed tube. However, paint is introduced into the device of FIGS. 12–14 without need for an opening in the rearward end thereof. Except for the relatively small, tortuous path defined by the space 114 between the protuberance 110 and channel 112, the rearward end of the device is closed, and because the space 114 is very small, any flow of air into the device is substantially impeded. Consequently, paint flowing across the paint feed surfaces 124 and 126 and through the passages 128 does not receive substantial exposure to air, and entrainment of air in paint is further minimized.

While embodiments of the invention have been described in detail, various modifications and other embodiments thereof may be devised by one skilled in the art without departing from the spirit and scope of the invention, as defined in the appended claims.

What is claimed is:

1. Apparatus for atomizing liquid coating material for electrostatic deposition on an article, comprising an annular housing rotatable about its axis and accommodating introduction of coating material therein, said housing having a smooth inner surface and a single row of discrete, individual and circumferentially spaced passages extending therethrough in directions outwardly of said axis; and means for introducing coating material into said housing, said housing upon rotation of said housing and introduction of coating material into said housing, causing the material to flow under centrifugal force in a thin film across said smooth inner surface toward, into and through said passages, said discrete passages causing the material therein to attain the same rotational velocity as said housing and to be atomized as it is projected from and beyond said passages, whereby to effect improved atomization of the material, said housing further having a relatively sharp and circumferentially extending edge on the outer periphery thereof in close proximity with outlets from said passages for enhancing an electrostatic charge imparted to projected material when a voltage gradient is established between said housing and the article.

2. Apparatus as in claim 1, wherein said housing comprises a circular front wall rotatable about said axis and an annular side wall connected with and extending axially from said front wall, said passages extending through said housing between points in proximity with the junctures of inner and outer surfaces of said front and side walls, said means for introducing accommodating introduction of liquid coating material onto said inner surface of said front wall, whereby upon rotation of said housing and introduction of material onto said inner surface of said front wall the material flows in a continuous thin film under centrifugal force radially outwardly along said surface and to said passages and then into and through said passages for being atomized as it is projected therefrom.

3. Apparatus as in claim 1, wherein said housing has a circular front wall rotatable about said axis and an annular side wall connected with and extending axially therefrom, said side wall has an inner surface extending both radially and axially outwardly of said axis and said passages extend through said housing in close proximity with the juncture of said front and side walls, and wherein said introducing means introduces coating material onto said side wall rearwardly of said front wall, so that upon rotation of said housing the material flows in a continuous thin film under centrifugal force across said side wall inner surface to and through said passages.

4. Apparatus as in claim 2, wherein said front and side wall outer surfaces define said relatively sharp peripheral edge at their juncture and said passages extend into said edge.

5. Apparatus as in claim 2, wherein said front and side wall outer surfaces define said relatively sharp peripheral edge at the juncture, said front wall has an annular recess in said outer surface thereof inwardly of said edge in close proximity therewith and said passages extend into said recess.

6. Apparatus as in claim 2, wherein said front wall outer surface extends radially outwardly of said side wall outer surface and defines said relatively sharp peripheral edge at its outermost end, and said passages extend to said side wall outer surface in close proximity to the juncture thereof with said front wall outer surface.

7. Apparatus as in claim 2, wherein said passages extend to said side wall outer surface at points toward the juncture thereof with said front wall outer surface.

8. Apparatus as in claim 3, wherein said side wall inner surface has first and second annular and conical surface portions, and said second portion extends between said first portion and said front wall and defines with said axis an acute angle which is less than the acute angle defines by said first surface portion.

9. Apparatus as in claim 8, wherein said introducing means introduces coating material onto said first surface portion.

10. Apparatus as in claim 9, wherein said introducing means introduces coating material onto said first surface portion at a point slightly vertically below and horizontally to the side of said axis and in a direction generally along the direction of rotation of said first surface portion thereat.

11. Apparatus as in claim 3, wherein a rearward end of said housing is substantially closed to atmosphere to impede any free flow of air therethrough upon rotation thereof.

12. A method of atomizing liquid coating material using a rotary atomizing device for electrostatically coating an article with a film of material, wherein an electrostatic field is established between a peripheral edge of the rotating device and the article to be coated and the liquid material flows across a smooth material feed surface of the device and toward the edge as a continuous thin film, characterized by increasing the rotational velocity of the material as it approaches the peripheral edge by flowing the material into and through a single row of a series of discrete, individual and circumferentially spaced passages which extend through the device in directions toward the edge, constrain the material to the same rate of rotation thereas and terminate in proximity with the edge, atomizing the material as it is projected out of and beyond the passages, and enhancing an electrostatic charge imparted to the material by providing on the outer periphery of the device a relatively sharp and circumferentially extending edge in close proximity with outlets from the passages.

* * * * *